US005349185A

United States Patent [19]

Mendenhall

[11] Patent Number: 5,349,185

[45] Date of Patent: Sep. 20, 1994

[54] HIGH RESOLUTION DETECTOR DEVICE FOR A PARTICLE TIME-OF-FLIGHT MEASUREMENT SYSTEM

[75] Inventor: Marcus H. Mendenhall, Nashville, Tenn.

[73] Assignee: Vanderbilt University, Nashville, Tenn.

[21] Appl. No.: 83,675

[22] Filed: Jun. 25, 1993

[51] Int. Cl.[5] ..... H01J 49/40; H01J 49/44

[52] U.S. Cl. ..... 250/287; 250/305; 250/397

[58] Field of Search ..... 250/287, 305, 397

[56] References Cited

U.S. PATENT DOCUMENTS

| | | | |
|---|---|---|---|
| 4,490,610 | 12/1984 | Ulbricht, Jr. | 250/287 |
| 4,568,394 | 9/1989 | Fukuhara et al. | 250/397 |
| 4,611,118 | 9/1986 | Managadze | 250/287 |
| 5,026,988 | 6/1991 | Mendenhall | 250/287 |
| 5,045,694 | 9/1991 | Beavis et al. | 250/287 |
| 5,128,543 | 7/1992 | Reed et al. | 250/287 |

*Primary Examiner*—Jack I. Berman

*Attorney, Agent, or Firm*—Mark J. Patterson; Edward D. Lanquist, Jr.; I. C. Waddey, Jr.

[57] ABSTRACT

A microchannel plate detector device is intended for use in the detection of low energy electrons and negative ions in particle time-of-flight measurement systems. A vacuum isolator isolates the microchannel plate signal output from ground as well as from the vacuum chamber of the meaurement system. A coupling unit includes a pulse isolator for separating pulse signals from the microchannel plate DC bias voltage. Electronic circuitry matches the output impedance of the coupling unit to the input impedance of the measurement system signal processor, thereby minimizing reflection and distortion of high frequency pulse signals.

5 Claims, 7 Drawing Sheets

HIGH RESOLUTION DETECTOR DEVICE FOR A PARTICLE TIME-OF-FLIGHT MEASUREMENT SYSTEM

BACKGROUND OF THE INVENTION

The present invention relates generally to particle time-of-flight measurement systems and more particularly to particle detector devices used in conjunction with such systems capable of detecting particles at low energy and with high timing resolutions.

It will be appreciated by those skilled in the art that particle time-of-flight measurement techniques are useful in both ion back scattering systems, as shown, for example, in Applicant's U.S. Pat. No. 5,026,988 issued Jun. 25, 1991, and entitled "Method and Apparatus for Time-of-Flight Medium Energy Particle Scattering", and in mass spectrometry such as that described in U.S. Pat. No. 4,490,610 issued Dec. 25, 1984, to the United States of America. In many such systems, microchannel plate detectors are used in order to generate start and stop pulse signals for determining the time-of-flight of particles which enter the detector. In prior art microchannel plate detectors, the rear plate surface or anode of the microchannel plate is operated at or near DC ground potential with the front plate surface or cathode typically biased at −2,000 volts DC. This creates a voltage differential across the microchannel plate which has an accelerating effect on the particles which approach the plate. Such a biasing scheme also allows the microchannel plate detector to be coupled to the signal processor of a time-of-flight measurement system using conventional BNC connector having a grounded shield side.

Unfortunately, the biasing schemes of prior art microchannel plate detectors do not allow them to be used effectively in detection of low energy electrons and negative ions, because the negative potential at the cathode repels these particles. Consequently, some in the prior art have attempted to modify the DC biasing scheme on microchannel plate detectors such that the cathode of the microchannel plate is operated at or near ground, with a substantially more positive DC potential applied to the anode. However, when one uses such a "grounded cathode" biasing scheme, the high DC voltages must be isolated from the BNC connectors in the system because they are not rated to withstand a 2,000 volt potential across the signal and shield sides. A conventional prior art response to this problem has been to use simple capacitive decoupling to separate the pulse signals from the detector from the underlying DC bias voltage. This, however, creates an additional problem when the microchannel plate detector is to be operated with high timing resolutions, typically better than 500 picoseconds. Using conventional capacitive decoupling at the interface between the microchannel plate detector and the measurement system signal processor produces distortion and reflection of the pulse signal due to an impedance mismatch at the interface. This distortion and reflection of the signal pulse will produce inaccuracies in the measurement of the particle time-of-flight.

What is needed, then, is a microchannel plate detector device which can accurately detect low energy electrons and negative ions with high timing resolution, and which can easily be coupled to conventional time-of-flight measurement systems using standard connectors. Such a device is presently lacking in the prior art.

SUMMARY OF THE INVENTION

In the present invention, a high resolution microchannel plate detector device incorporates a conventional microchannel plate assembly located within a vacuum chamber portion of a time-of-flight measurement system. The cathode of the microchannel plate is operated at or near ground and the anode is biased to a substantially higher positive DC voltage, allowing for the acceleration and detection of low energy electrons and negative ions. A vacuum isolator, mounted to a vacuum chamber mounting flange, is electrically connected to the microchannel plate assembly and isolates the output of the plate assembly from the grounded vacuum chamber of the time-of-flight measurement system. Pulse signals from the microchannel plate assembly are connected to and transmitted through the vacuum isolator by a matched BNC connector.

A coupling unit, mounted to the opposite end of the vacuum chamber mounting flange, includes a pulse isolator circuit having an input which receives signals from the vacuum isolator, with the shield side of the input connector connected to the DC bias voltage supply. DC decoupling and impedance matching circuitry within the pulse isolator allow for the transmission of fast timing pulse signals through the pulse isolator to the signal processor of the time-of-flight measurement system. Because of the decoupling circuitry, the shield side of the output connector of the pulse isolator can be grounded in conventional fashion to the input connector of the signal processor. The impedance matching circuitry minimizes reflection and distortion of the pulse signals at the interface.

An object of the present invention, then, is to provide a microchannel plate detector device that can be used to detect low energy electrons and negative ions.

Another object of the present invention is to provide a microchannel plate detector device which can be used in conjunction with a conventional time-of-flight measurement system signal processor having a grounded vacuum chamber and grounded shield BNC connection devices.

A further object of the present invention is to provide a device for coupling the output of a microchannel plate detector assembly to the input of a time-of-flight measurement signal processor without distorting the pulse signals from the detector or creating unwanted reflection of such signals from the coupling unit.

DESCRIPTION OF THE PREFERRED EMBODIMENT

Figure 1:
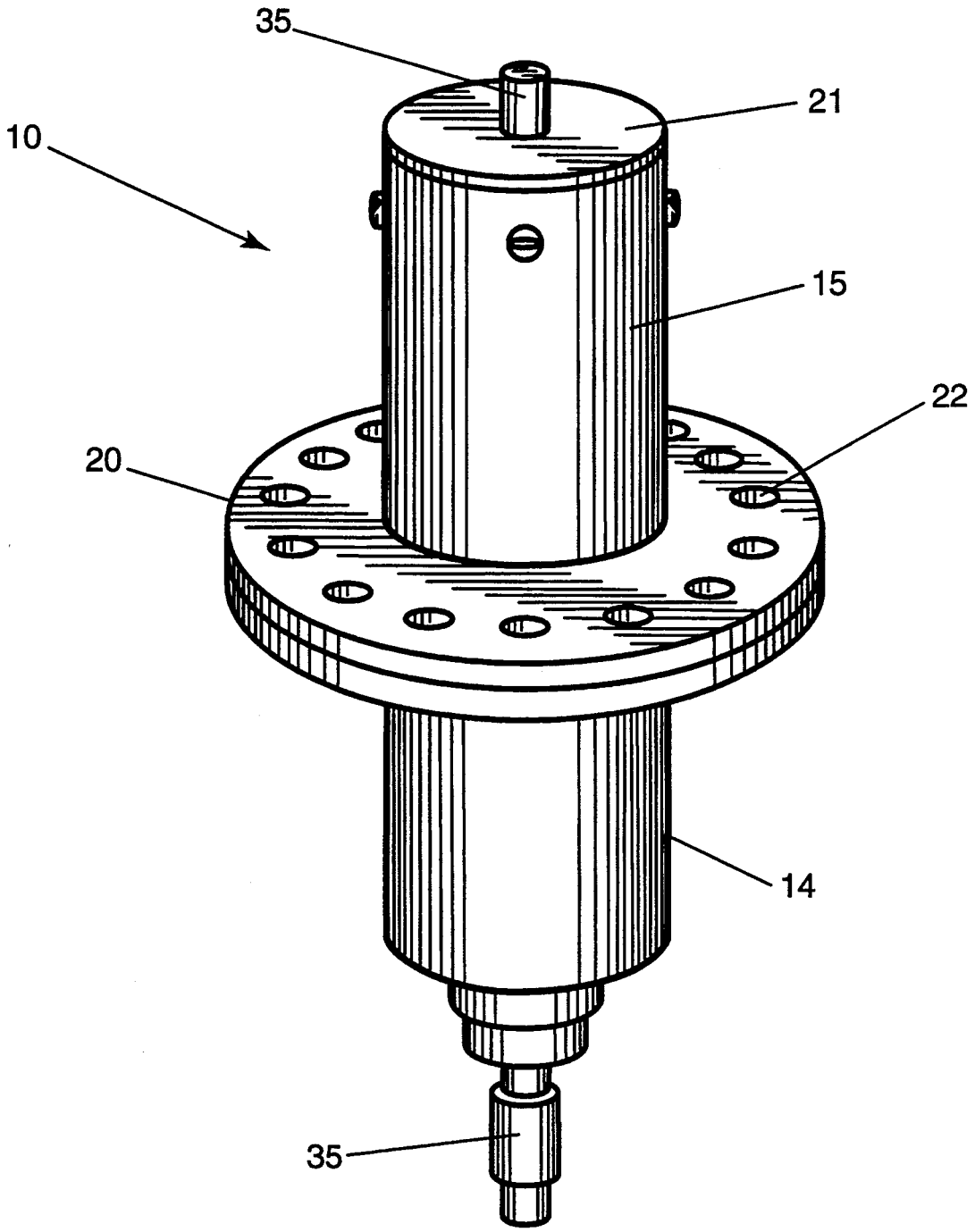
FIG. 1 is a perspective view of the vacuum isolator and coupling unit of the detector device of the present invention, separated from the microchannel plate detector assembly.
Figure 2:
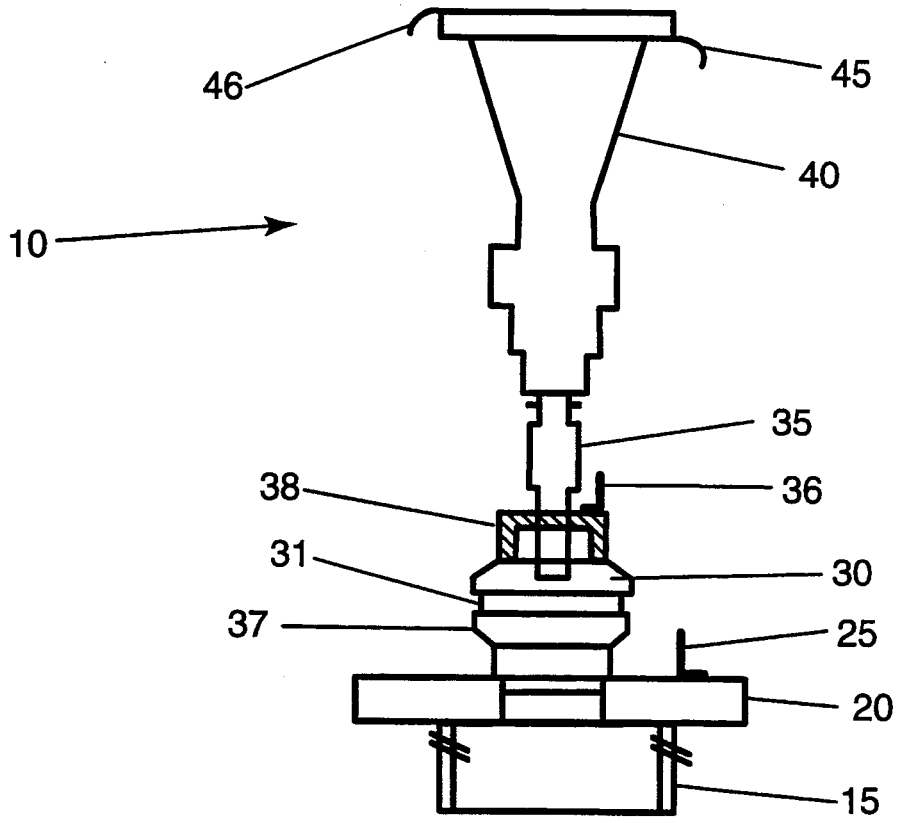
FIG. 2 is a side view showing the vacuum isolator assembly connected to the microchannel plate detector device of the present invention.

Referring to FIGS. 1 and 2, the detector device 10 of the present invention includes, on the input side, a conventional microchannel plate assembly 40, and is electrically connected on its output side to a signal processor (not shown) as part of a time-of-flight mass spectrometer or ion back scattering analyzer which uses time-of-flight measurement techniques. In such applications, time-of-flight measurement systems are operated in an evacuated environment. Accordingly, device 10 of the present invention includes a flange 20 so that device 10 can be mounted to a vacuum chamber (not shown) by means of mounting bolts (also not shown) placed through flange mounting holes 22.

Flange 20 is, in the preferred embodiment, of the Conflat ® type well known in the prior art and includes an opening 21 centrally disposed through the body of flange 20, to allow for the passage of electrical wiring discussed below. Lower and upper extender tubes 14 and 15, preferably made of thin-wall metal tubing, are attached on either side of flange 20.

Figure 3:
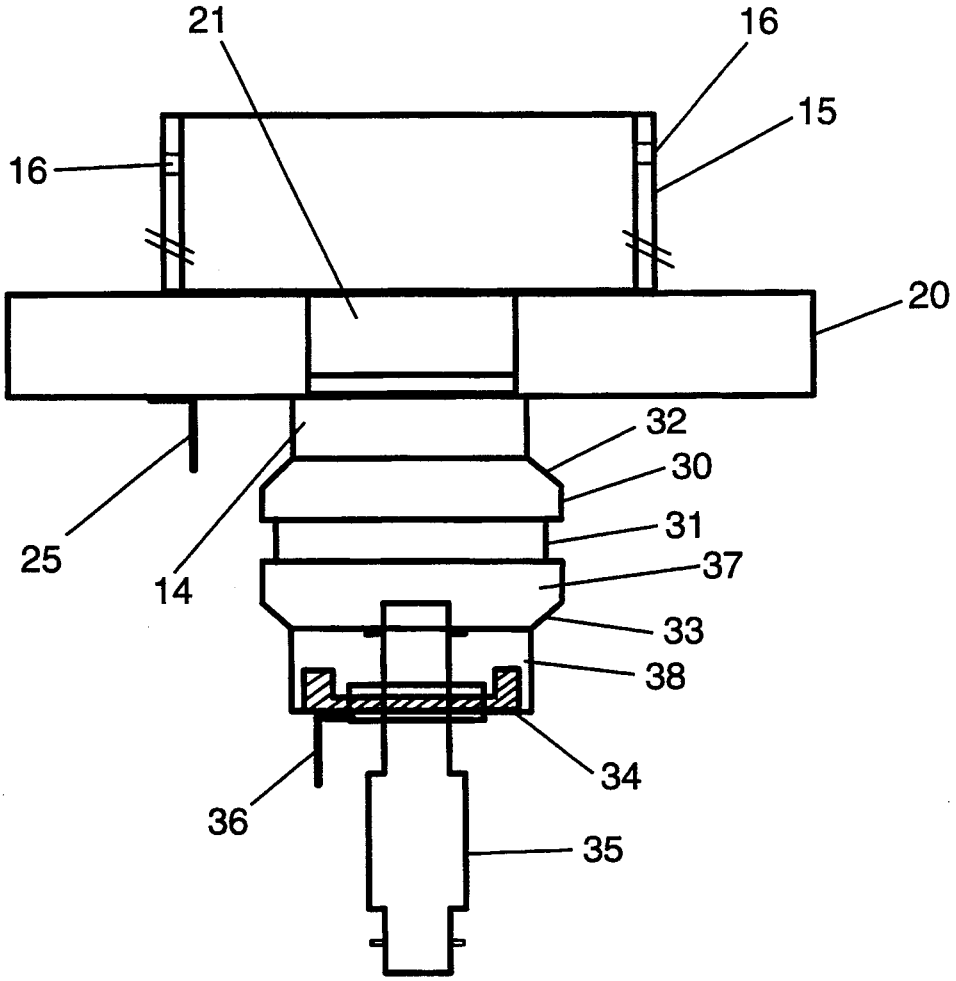
FIG. 3 is a an enlarged side view of the vacuum isolator assembly of the detector device.
Figure 4:
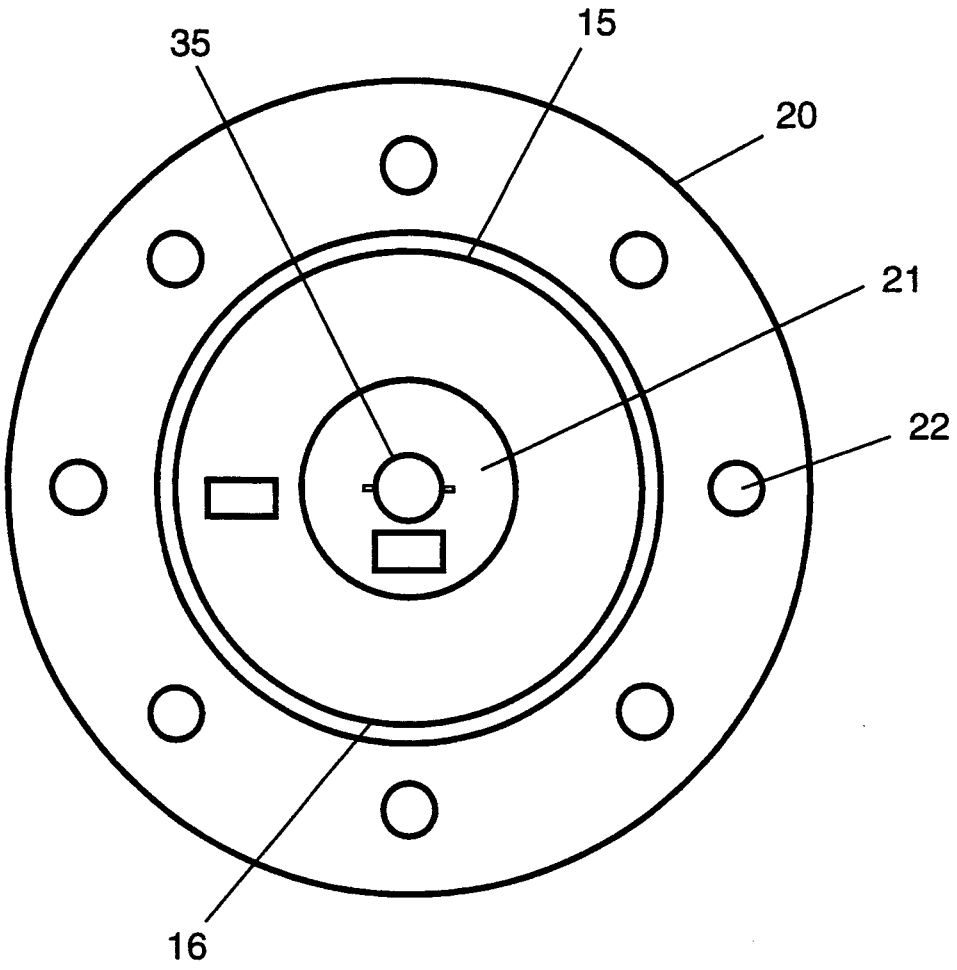
FIG. 4 is a top view of the vacuum isolator assembly of the detector device, looking down through the upper extender tube.

Looking now at FIGS. 3 and 4, a vacuum isolator assembly 30 is secured to and extends outwardly from the distal (vacuum chamber) end of lower extender tube 14. Vacuum isolator assembly 30 includes a vacuum isolator 37 having a ceramic insulator 31 disposed between an upper metal section 32 and a lower metal section 33. In the preferred embodiment, vacuum isolator 37 is a Model 807B9999-03-W manufactured by Ceramaseal Corporation of New Lebanon, N.Y. Extending below lower metal section 33 of vacuum isolator 37 is connector flange 38. An insert 34, preferably made of stainless steel, is placed within and welded to connector flange 38 so as to accommodate the attachment of vacuum isolator input connector 35. Isolator terminal 36 allows for convenient DC electrical connections.

Input connector 35 is preferably a 50 ohm matched BNC connector, such as the Model 807B3506-01-W from Ceramaseal Corporation. As will be apparent to those skilled in the art, ceramic insulator 31 provides an electrical discontinuity along vacuum isolator assembly 30. As a result, both the signal and shield sides of input connector 35 are electrically isolated from lower extender tube 14, flange 20, upper extender tube 15, and the other metal components (not shown) of the vacuum chamber associated with the time-of-flight measurement system.

At the distal (ambient air) end of upper extender tube 15 is attached a signal coupling unit 50, which is secured by mounting screws 17 placed through mounting screw holes 16. Coupling unit 50 includes a mounting plate 49 and a flange 51 which extends over the wall end surface of upper extender tube 15. Looking at FIGS. 5 and 6, a pulse isolator 53 is attached to the inner surface of mounting plate 49 by support bars 55. Screws 58 (FIG. 5) hold support bars 55 to mounting plate 49. Screws 56 (FIG. 6) hold pulse isolator 53 to support bars 55.

Also attached to and extending through mounting plate 49 of coupling unit 50 is bias voltage connector 57 which, in the preferred embodiment, is a standard SHV connector with a grounded shield side. The signal side input of connector 57 is electrically connected to a DC bias voltage supply operating in the preferred embodiment at approximately 2200 volts.

In the preferred embodiment, pulse isolator 53 includes both means for decoupling DC bias voltages from high frequency pulse signals and electronic circuit means for matching the output impedance, also at high pulse frequencies, of coupling unit 50 to the input impedance of the signal processor portion of the time-of-flight measurement system. Accordingly, looking at FIG. 6 and FIG. 7, an equivalent circuit for such a device as used in the preferred embodiment is shown. Pulse isolator input connector 54 extends outwardly from pulse isolator 53. The signal side of pulse isolator input connector 54 is connected to the signal side of vacuum isolator input connector 35. The shield side of pulse isolator input connector 54 is connected to the signal side of bias voltage connector 57 (through decoupling resistor 70, typically 100 k ohms in value) and also to isolator terminal 36. Accordingly, the shield side of pulse isolator input connector 54 is electrically at the potential of the DC bias voltage supply means.

Figure 5:
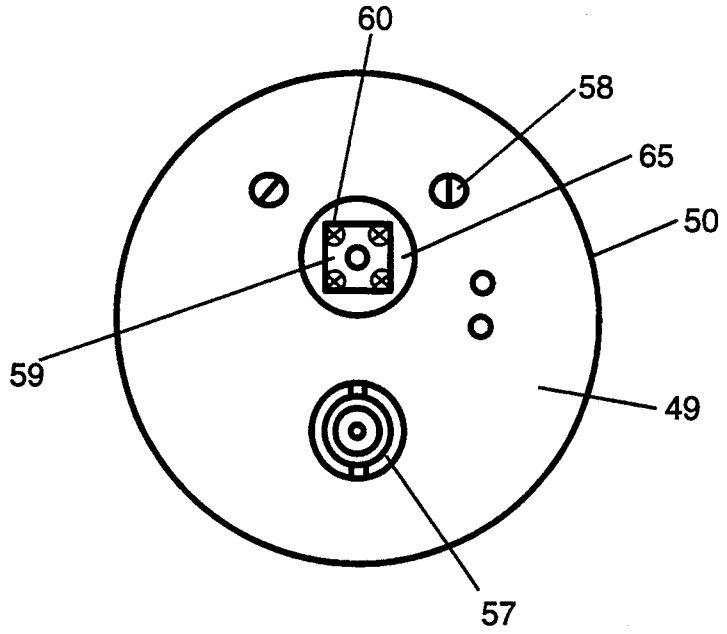
FIG. 5 is an outside end view of the coupling unit of the detector device of the present invention.
Figure 6:
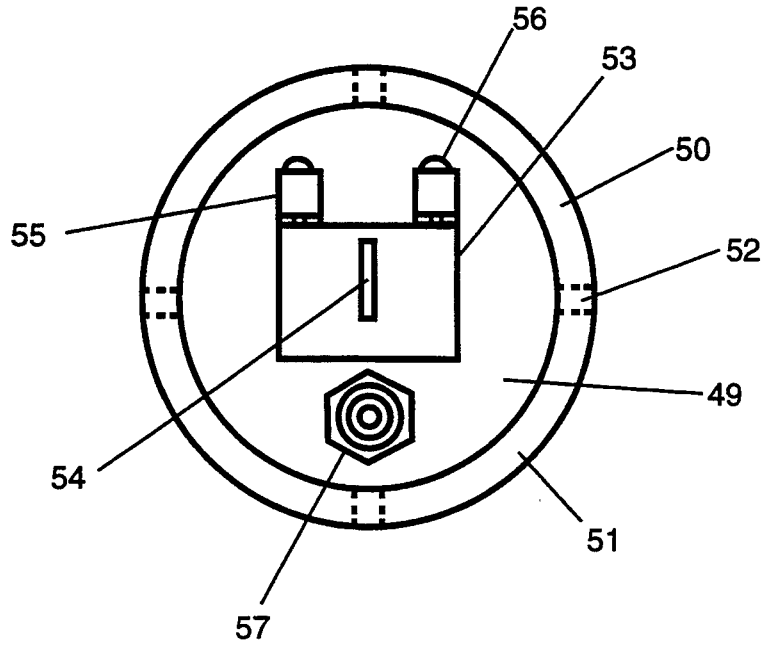
FIG. 6 is an inside end view of the coupling unit of the detector device of the present invention.

Pulse signal output connector 59, preferably of the SMA type, is attached to the side of pulse isolator 53 opposite input connector 54 by means of screws 60 (FIG. 5). Connector 59 is accessible from outside of coupling unit 50 through circular opening 65 in mounting plate 49. A shielded cable (not shown) from the input of the signal processor of the time-of-flight measurement system attaches to connector 59.

Figure 7:
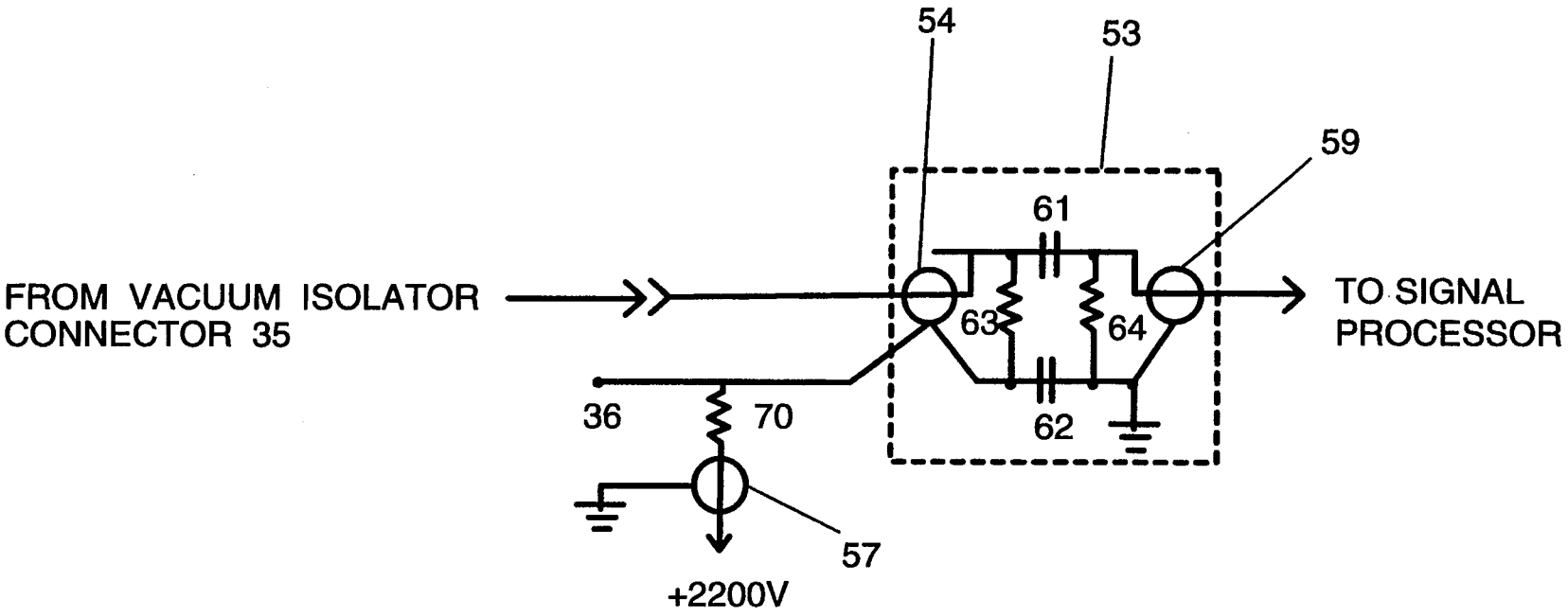
FIG. 7 is a schematic representation of the pulse isolator equivalent circuit of the detector device of the present invention.

Electrically disposed between pulse isolator input connector 54 and pulse signal output connector 59 are DC decoupling capacitors 61 and 62 and resistors 63 and 64, as shown on FIG. 7. In the preferred embodiment, resistors 63 and 64, capacitors 61 and 62, and pulse isolator input connector 54 are integral to a conventional micro-strip transmission line, which is designed, also in conventional fashion, to match the output impedance of coupling unit 50 to the input impedance of the signal processor of the time-of-flight measurement system. The impedance matching characteristics of pulse isolator 53 must be calculated with reference to the preferred timing resolution of device 10 (preferably 500 picoseconds or better) such that reflection and distortion of pulse signals at the interface between coupling unit 50 and the signal processor are minimized. Such a device is available, for example, from Avtech Electrosystems, Inc. of Ottawa, Canada.

Figure 8:
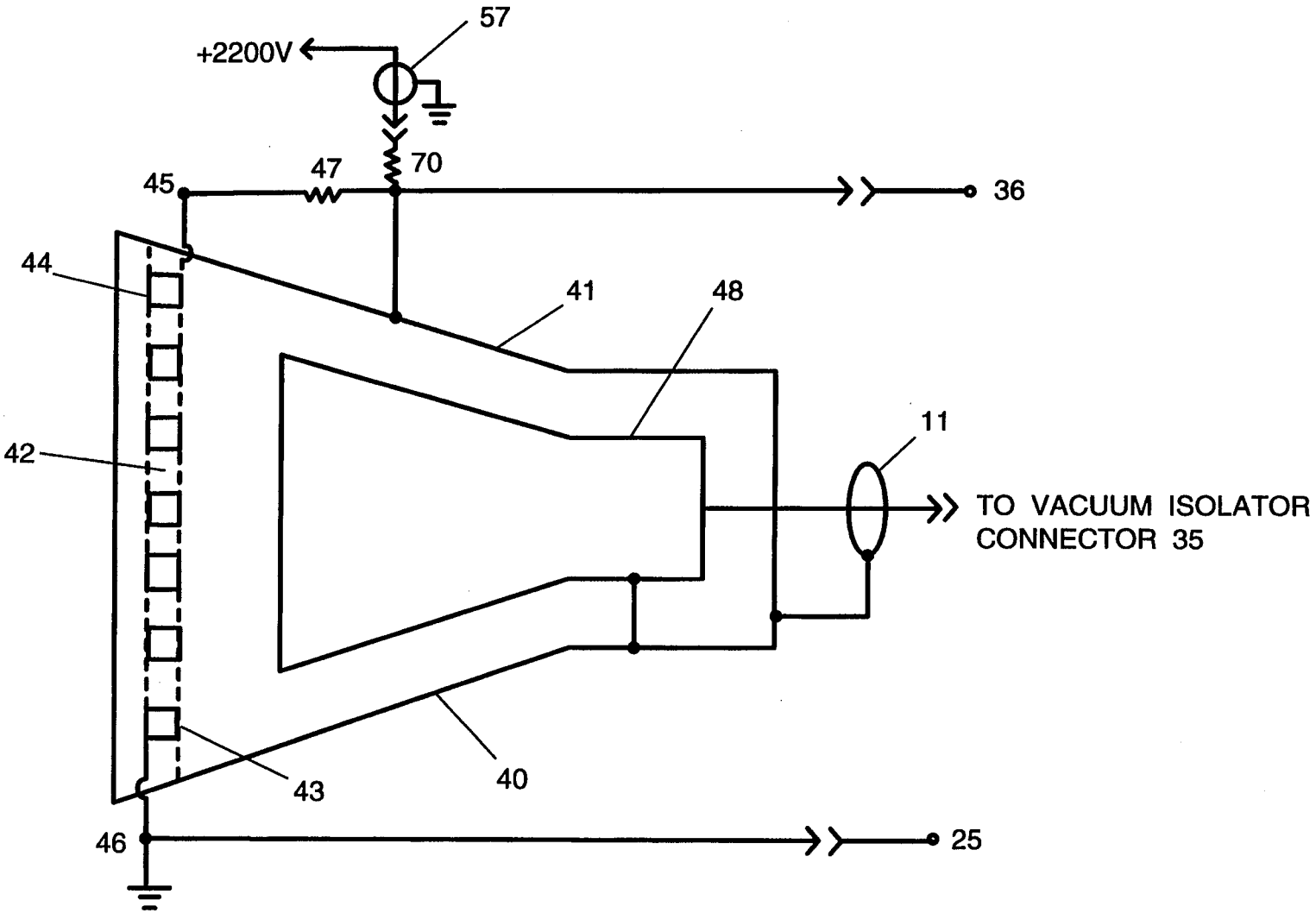
FIG. 8 is a schematic representation of a commercially available microchannel plate detector assembly as used in the present invention.

FIG. 8 is a schematic representation of the microchannel plate assembly 40 of the present invention which includes a conventional microchannel plate 42, such as the FTD-2003 available from Galileo Electro Optics of Sturbridge, Mass. Plate 42 has a front electrical surface or anode 43 and a rear electrical surface or cathode 44. In a conventional microchannel plate, cathode 44 would be electrically isolated from anode 43 by at least two hundred megohms.

Plate 42 is physically placed within a detector housing 41 and in front of a particle collector housing 48 which is used as a means for receiving particles which are passed through the openings or microchannels in plate 42. Particles which enter collector housing 48 ultimately generate pulse signals which are electrically transmitted along the signal side of pulse signal output connector 11. The shield side of pulse signal output collector 11 is electrically connected to detector housing 41 and to the outside surface of collector housing 48.

In order to properly accelerate electrons through plate 42, a DC bias voltage is applied to anode 43 through decoupling resistor 70 and a second coupling resistor 47 which is electrically and mechanically attached to anode terminal 45 which extends from outside detector housing 41, as best seen on FIG. 2. Cathode 44 is, through cathode terminal 46 (FIG. 2), electrically isolated both from detector housing 41 and from both sides of pulse signal output connector 11.

In the preferred embodiment, cathode 46 will be operated at a DC potential at or near ground and will be connected to flange terminal 25 located on flange 20 (FIG. 2). Preferably, the value of coupling resistor 47 will be approximately 10% of the internal cathode-to-anode resistance of channel plate 42, twenty megohms for example in one type of commercially available channel plate. Accordingly, with a DC bias voltage supply operating at +2200 volts and applied to the signal side of bias voltage connector 57, anode 43 will be operated at a DC bias of approximately +2000 volts. However, it will be apparent to those skilled in the art that both cathode 44 and anode 43 can be separately biased at any preferred level, within the breakdown ratings of the associated components, without affecting the ability of device 10 to easily interface with standard BNC input connectors having a grounded shield.

The information disclosed in U.S. Pat. No. 5,026,988, issued to applicant on Jun. 25, 1991, is incorporated herein by reference.

Thus, although there have been described particular embodiments of the present invention of a new and useful High Resolution Detector Device for a Particle Time-of-Flight Measurement System, it is not intended that such references be construed as limitations upon the scope of this invention except as set forth in the following claims. Further, although there have been described certain specifications and operational parameters used in the preferred embodiment, it is not intended that such parameters be construed as limitations upon the scope of this invention except as set forth in the following claims.

What I claim is:

1. A detector device for a particle time-of-flight measurement system, said device comprising:

a. a microchannel plate detector assembly, including a microchannel plate having a cathode electrically isolated from an anode;

b. means to supply an electron accelerating DC bias voltage to said anode;

c. means for coupling pulse signals from said microchannel plate detector assembly to a time-of-flight measurement signal processor; and d. said coupling means comprising a pulse signal output connector having a signal side and a shield side, and further comprising means for electrically isolating said shield side and said signal side from said DC bias voltage, whereby said anode and said cathode can be biased at DC electric potentials which are substantially different from ground.

2. The device of claim 1, said coupling means further comprising means for minimizing reflection and distortion of said pulse signals at said pulse signal output connector.

3. The device of claim 2, said means for minimizing pulse signal reflection and distortion comprising an electronic circuit means for matching, at high pulse frequencies, the output impedance of said coupling means to the input impedance of said signal processor.

4. A device for coupling signals from a microchannel plate detector to a signal processor in a particle time-of-flight measurement system, said device comprising:

a. a pulse isolator;

b. said pulse isolator comprising an input connector having a signal side and a shield side, said signal side electrically connected to a pulse signal output connector on said microchannel plate detector and said shield side connected to means for supplying a particle accelerating DC bias voltage to an anode on said microchannel plate detector; and c. electronic circuit means for separating said DC bias voltage from said pulse signals and for matching, at high pulse frequencies, the output impedance of said coupling device to the input impedance of said signal processor.

5. The device of claim 4 further comprising:

a. vacuum isolator assembly means for operating said device within a vacuum chamber in said time-of-flight measurement system;

b. a flange for attaching said vacuum isolator means and said microchannel plate detector to said vacuum chamber; and c. said vacuum isolator means comprising a vacuum isolator input connector having a signal side and a shield side, said shield side electrically connected to said DC bias voltage supply means.

* * * * *

UNITED STATES PATENT AND TRADEMARK OFFICE

CERTIFICATE OF CORRECTION

PATENT NO. : 5,349,185
DATED : September 20, 1994
INVENTOR(S) : Marcus H. Mendenhall It is certified that error appears in the above-identified patent and that said Letters Patent is hereby corrected as shown below:

At column 1, beginning at line 5, please insert the following:

–This invention was made with government support under Grant No. DAAL03-92-G-0037 awarded by the Army Research Office. The government has certain rights in this invention.—

Signed and Sealed this

Nineteenth Day of August, 1997

*Attest:*

Bruce Lehman

BRUCE LEHMAN

*Attesting Officer*

*Commissioner of Patents and Trademarks*